US009173471B2

(12) United States Patent
Inoue et al.

(10) Patent No.: US 9,173,471 B2
(45) Date of Patent: Nov. 3, 2015

(54) LIQUID COSMETIC CONTAINER

(75) Inventors: Takashi Inoue, Kawaguchi (JP); Masahiro Tanaka, Kawaguchi (JP)

(73) Assignee: TOKIWA CORPORATION, Nakatsugawa-Shi, Gifu (JP)

( * ) Notice: Subject to any disclaimer, the term of this patent is extended or adjusted under 35 U.S.C. 154(b) by 757 days.

(21) Appl. No.: 13/206,814

(22) Filed: Aug. 10, 2011

(65) Prior Publication Data

US 2012/0063835 A1 Mar. 15, 2012

(30) Foreign Application Priority Data

Sep. 9, 2010 (JP) ..... 2010-202135

(51) Int. Cl.
*A45D 34/04* (2006.01)

(52) U.S. Cl.
CPC ..... *A45D 34/046* (2013.01); *A45D 34/042* (2013.01); *A45D 2200/054* (2013.01)

(58) Field of Classification Search
CPC .. A45D 34/042; A45D 34/045; A45D 34/046
USPC ..... 401/118, 119, 121–130
See application file for complete search history.

(56) References Cited

U.S. PATENT DOCUMENTS 3,311,941 A * 4/1967 Baker et al. ..... 401/4
3,554,657 A * 1/1971 Aston ..... 401/122
3,951,157 A * 4/1976 Idec ..... 401/122
4,189,245 A * 2/1980 Bennett ..... 401/126
4,841,996 A * 6/1989 Gueret ..... 132/320
4,889,228 A * 12/1989 Gueret ..... 206/209
4,952,204 A * 8/1990 Korteweg ..... 604/1
4,982,838 A * 1/1991 Fitjer ..... 206/209
5,324,128 A * 6/1994 Gueret ..... 401/126
5,620,270 A * 4/1997 Gueret ..... 401/126
5,636,931 A * 6/1997 Gueret ..... 401/126
5,641,078 A * 6/1997 Kaufmann ..... 211/69.4
5,782,568 A * 7/1998 Roder et al. ..... 401/122

(Continued)

FOREIGN PATENT DOCUMENTS

JP H01-99310 7/1989
JP H03-68816 7/1991

(Continued)

OTHER PUBLICATIONS

Chinese examination report dated Jul. 3, 2014 issued in a corresponding CN application No. 201110272596.7.

*Primary Examiner* — David Walczak
*Assistant Examiner* — Bradley Oliver
(74) *Attorney, Agent, or Firm* — Bacon & Thomas, PLLC

(57) ABSTRACT

The invention protects an application body as well as reducing a remaining amount of a liquid cosmetic. A bag-like container accommodates liquid cosmetic therein and provides an opening neck portion to communicate the inner side and the outer side thereof, a pipe portion in the opening neck portion extends to the bag portion bottom side. The pipe portion peripheral surface has an opening for the liquid cosmetic going into an internal portion. An application body in a lid portion goes into the pipe portion by installing the lid portion to the opening neck portion to reach the opening position. If a user pushes and squeezes the bag portion, the liquid cosmetic goes into the pipe portion through the opening, the application body dips into the liquid cosmetic to run short of the liquid cosmetic and to protect the application body by the pipe.

14 Claims, 6 Drawing Sheets

(56) References Cited

U.S. PATENT DOCUMENTS

| | | | | |
|---|---|---|---|---|
| 5,884,634 | A * | 3/1999 | Sheffler et al. | 132/218 |
| 5,899,622 | A * | 5/1999 | Gueret | 401/122 |
| 6,039,487 | A * | 3/2000 | Kristiansen | 401/126 |
| 7,223,035 | B1 * | 5/2007 | Engel | 401/126 |
| 7,398,898 | B2 * | 7/2008 | Bouix et al. | 222/183 |
| 7,641,409 | B1 * | 1/2010 | Wilde et al. | 401/122 |
| 8,262,302 | B1 * | 9/2012 | Bouix et al. | 401/1 |
| 2003/0077104 | A1 * | 4/2003 | Schrepf | 401/129 |
| 2004/0096259 | A1 * | 5/2004 | Theile | 401/126 |
| 2009/0279937 | A1 * | 11/2009 | Peck et al. | 401/128 |
| 2009/0304433 | A1 * | 12/2009 | Peck et al. | 401/126 |
| 2009/0324318 | A1 * | 12/2009 | Wilde et al. | 401/122 |
| 2011/0052304 | A1 * | 3/2011 | Chevalier et al. | 401/122 |
| 2012/0099918 | A1 * | 4/2012 | Dambricourt | 401/122 |
| 2012/0325235 | A1 * | 12/2012 | Bouix et al. | 132/200 |
| 2013/0112591 | A1 * | 5/2013 | Allbritton | 206/581 |

FOREIGN PATENT DOCUMENTS

| | | | |
|---|---|---|---|
| JP | 09-103322 | A | 4/1997 |
| JP | 2006-102478 | A | 4/2006 |

* cited by examiner

LIQUID COSMETIC CONTAINER

BACKGROUND OF THE INVENTION

1. Field of the Invention

The present invention relates to a liquid cosmetic container for applying a liquid cosmetic.

2. Description of the Conventional Art

Conventionally, as a liquid cosmetic container with an application body which accommodates a liquid cosmetic such as a mascara, a lip gloss or the like and can apply the liquid cosmetic, a bottle type has been generally known. In the case of this bottle type liquid cosmetic container, there is a problem that a lot of liquid cosmetic which can not be used up by the attached application body is still left within the container.

Accordingly, the following Japanese Unexamined Patent Publication No. 2006-102478 and Japanese Unexamined Patent Publication No. 9-103322 disclose a liquid cosmetic container with an application body of such a type that a liquid cosmetic is accommodated in an inner portion of a bag-like container, in order to overcome the problem of the bottle type mentioned above. The liquid cosmetic container is structured such as to have a bag-like container which has an opening neck portion communicating an inner side and an outer side of a bag portion as well as accommodating a liquid cosmetic within the bag portion, a lid portion which is detachably installed to the opening neck portion so as to form a lid of the opening neck portion, and an application body which is provided in the lid portion and goes into the bag portion through the opening neck portion at a time when the lid portion is installed to the opening neck portion so as to dip into the liquid cosmetic, and is structured such that a user detaches the lid portion from the opening neck portion and applies the liquid cosmetic attached to the application body to a portion to be applied, at a time of using. Further, in Japanese Unexamined Patent Publication No. 2006-102478, the bag-like container is made of a synthetic resin, for example, a polyethylene, a polypropylene or the like, and it is described as it is possible to run short of a good part of the liquid cosmetic by pushing and squeezing the bag-like container. Further, in Japanese Unexamined Patent Publication No. 9-103322, a bag-like container constructed by a film having an elasticity and a flexibility is accommodated in a hard container main body, and it is described as it is possible to collect a liquid cosmetic in an application body going into a bag portion on the basis of a self restoring force of the bag-like container to an original sheet shape going with a use, and it is possible to run short of a good part of the liquid cosmetic.

SUMMARY OF THE INVENTION

Problem to be Solved by the Invention

However, in the Japanese Unexamined Patent Publication No. 2006-102478, since the bag-like container is made soft for pushing and squeezing in order to run short of a good part of the liquid cosmetic, there is a problem that the application body going into the bag portion is deformed or broken if such a pressing force as to erroneously crush the bag-like container is applied from an external portion, whereby an applying function is deteriorated. Further, in Japanese Unexamined Patent Publication No. 9-103322, since the bag-like container is accommodated in the hard container main body, it is possible to prevent the application body going into the bag body from being deformed or broken even if the pressing force is applied from the external portion, however, it is impossible to laconically and sufficiently run short of the liquid cosmetic within the bag portion only by the self restoring force of the bag-like container.

Accordingly, an object of the present invention is to provide a liquid cosmetic container which can sufficiently run short of a liquid cosmetic, can sufficiently reduce a remaining amount and sufficiently protect an application body.

Means for Solving the Problem

According to an aspect of the present invention, there is provided a liquid cosmetic container comprising:

a bag-like container which is provided with a bag portion formed by aligning at least two films so as to join ends of the films to each other, and has an opening neck portion communicating an inner side and an outer side of the bag portion as well as accommodating a liquid cosmetic within the bag portion;

a lid portion which is detachably installed to the opening neck portion so as to form a lid of the opening neck portion; and an application body which is provided in the lid portion and goes into the bag portion through the opening neck portion at a time when the lid portion is installed to the opening neck portion, wherein the liquid cosmetic container comprises a pipe portion which is continuously provided in the opening neck portion so as to extend in such a manner as to head for a bottom portion side within the bag portion, is formed as a tubular shape capable of accommodating the application body, and is provided in its peripheral surface with an opening enabling the liquid cosmetic to go into an internal portion, and wherein the application body goes into the pipe portion so as to reach a position at which the opening of the pipe portion is provided, at a time when the lid portion is installed to the opening neck portion.

In accordance with the liquid cosmetic container mentioned above, since the liquid cosmetic is accommodated within the bag portion in the bag-like container, the bag-like container is provided with the pipe portion which is continuously provided in the opening neck portion so as to extend in such a manner as to head for the bottom portion side within the bag portion as well as being provided with the opening neck portion communicating the inner side and the outer side of the bag portion, the opening enabling the liquid cosmetic to go into the inner portion is provided in the peripheral surface of the pipe portion, and the application body provided in the lid portion goes into the pipe portion through the opening neck portion so as to be accommodated and reaches the position at which the opening of the pipe portion is provided, if the lid portion is installed to the opening neck portion, the liquid cosmetic goes into the pipe portion through the opening if the user pushes (squeezes) the bag portion, and the application body reaching the opening sufficiently dips into the liquid cosmetic. Accordingly, it is possible to sufficiently run short of the liquid cosmetic, and it is possible to sufficiently reduce the remaining amount. Further, since the application body is accommodated within the pipe portion as mentioned above, it is possible to sufficiently protect the application body by the pipe portion in the case that the pressing force of crushing the bag body is erroneously applied.

In this case, if the opening of the pipe portion is a slit extending in an axial direction of the pipe portion, it is possible to easily introduce the liquid cosmetic into the pipe portion through this slit, and it is possible to further run short of the liquid cosmetic so as to further reduce the remaining amount.

Further, if the slit is structured such as to be exposed at a whole length of the application body, the application body further sufficiently dips into the liquid cosmetic from the slit, and it is possible to further run short of the liquid cosmetic so as to further reduce the remaining amount.

Further, if the opening of the pipe portion is open to a position which is opposed to a joint portion joining the film ends to each other, it is possible to further protect the application body by a peripheral wall of the pipe portion since no opening is provided in a direction in which the pressing force crushing the bag portion is applied (a back and front direction of the bag-like container).

Further, if the joint portion joining the film ends to each other protrudes toward the opening, in a portion which is opposed to the opening of the pipe portion, the protruding joint portion and the opening form therebetween a flow path which is narrowed in comparison with the other portion. Therefore, if the user pushes the bag portion, the liquid cosmetic within the bag portion easily goes into the pipe portion while circulating in the vicinity of the opening, whereby it is possible to further run short of the liquid cosmetic so as to further reduce the remaining amount.

Effect of the Invention

As mentioned above, in accordance with the present invention, it is possible to sufficiently run short of the liquid cosmetic to reduce the remaining amount, and further sufficiently protect the application body.

DETAILED DESCRIPTION OF PREFERRED EMBODIMENT

Figure 5:
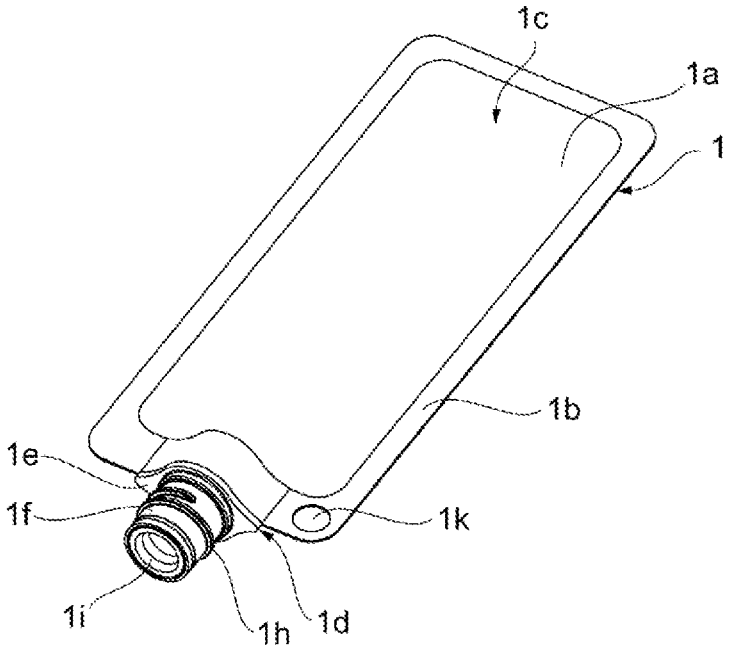
FIG. 5 is a perspective view showing a bag-like container in FIG. 1.
Figure 6:
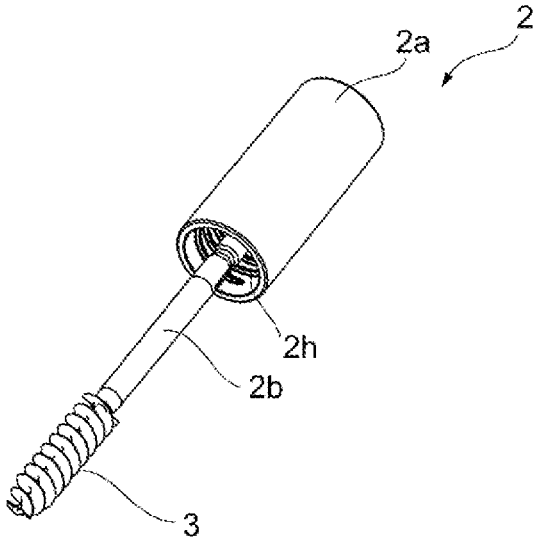
FIG. 6 is a perspective view showing a lid portion with an application body in FIG. 1.
Figure 7:
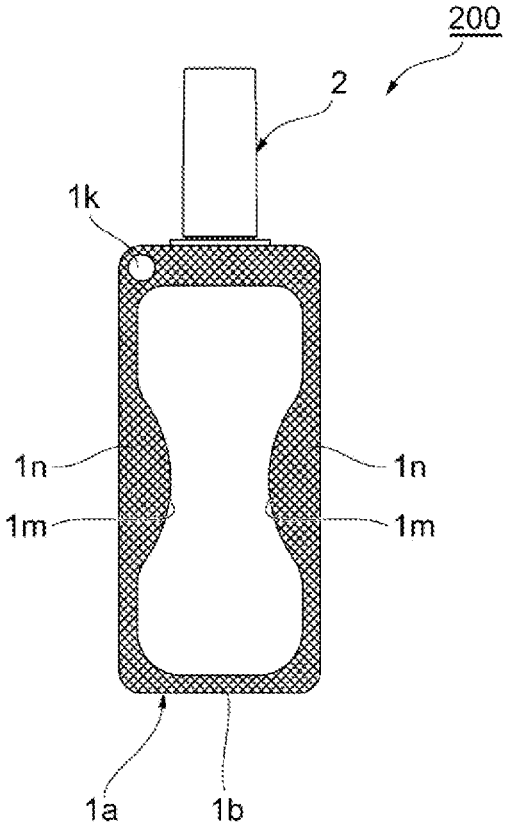
FIG. 7 is a view showing a liquid cosmetic container in accordance with a second embodiment of the present invention, and is a schematic plan view for explaining a shape of a joint portion.
Figure 8:
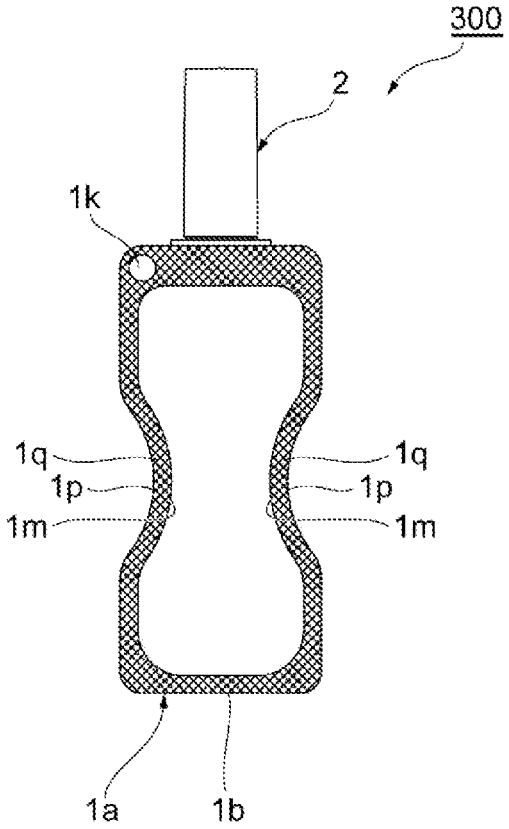
FIG. 8 is a view showing a liquid cosmetic container in accordance with a third embodiment of the present invention, and is a schematic plan view for explaining a shape of a bag-like container and a joint portion.

A description will be given below of a preferable embodiment of a cosmetic container in accordance with the present invention with reference to FIGS. 1 to 8. FIGS. 1 to 6 show a first embodiment in accordance with the present invention, FIG. 7 shows a second embodiment in accordance with the present invention, and FIG. 8 shows a third embodiment in accordance with the present invention, respectively. In each of the drawings, the same reference numerals are attached to the same elements, and an overlapping description will be omitted.

Figure 1:
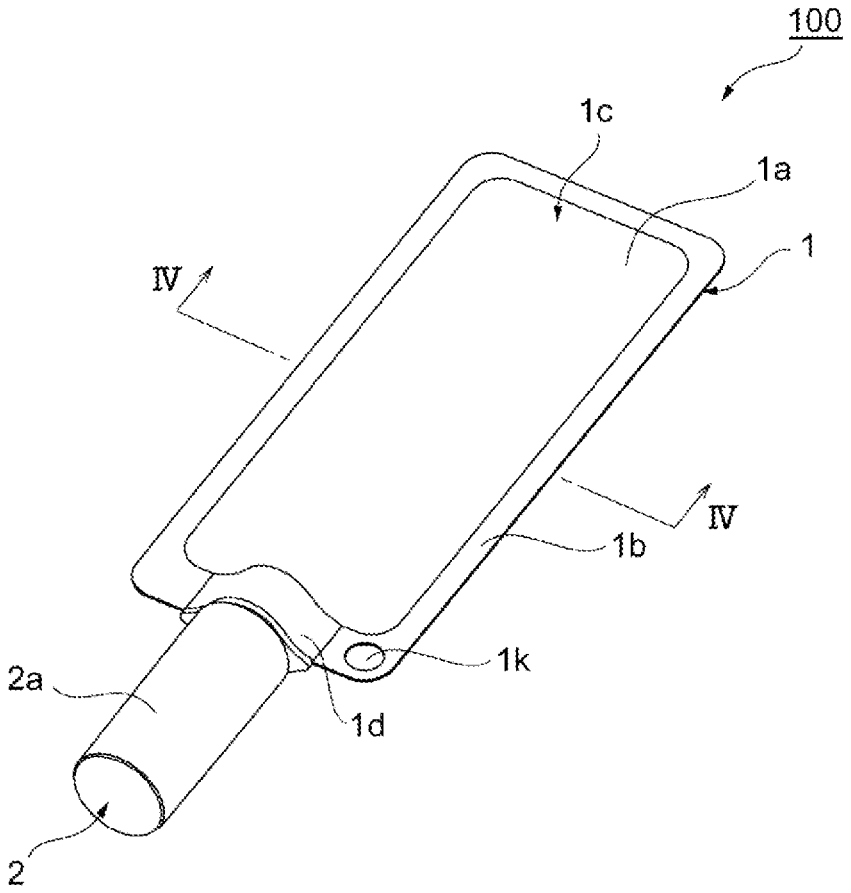
FIG. 1 is an outer appearance perspective view showing a liquid cosmetic container in accordance with a first embodiment of the present invention.
Figure 2:
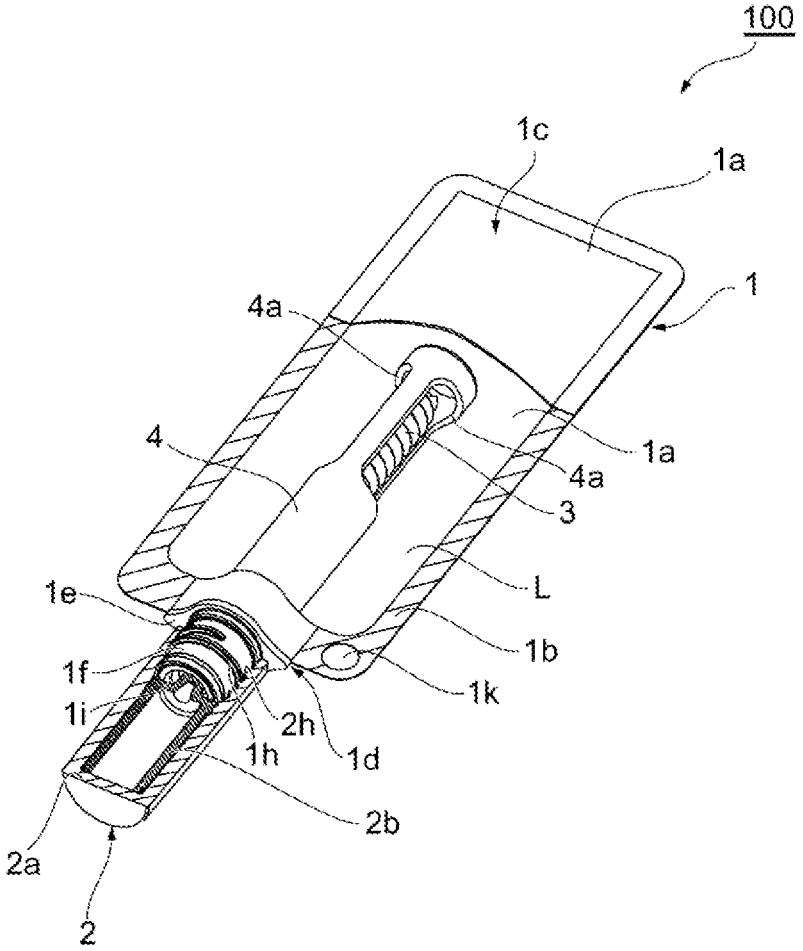
FIG. 2 is a partly ruptured perspective view of the liquid cosmetic container shown in FIG. 1.
Figure 3:
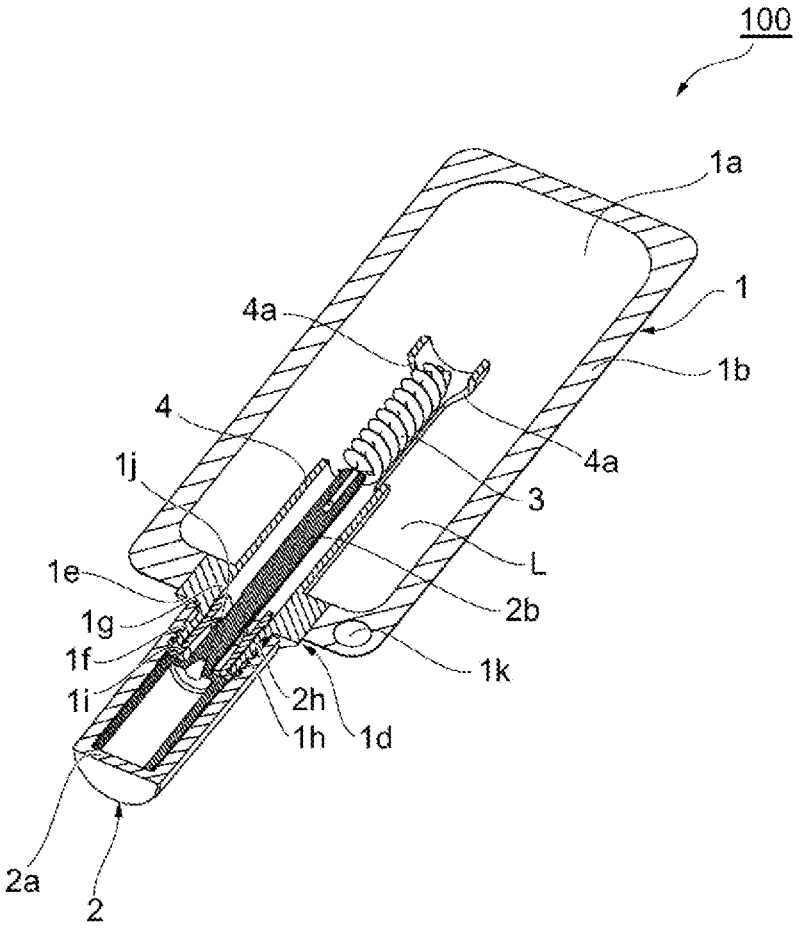
FIG. 3 is a vertical cross sectional perspective view of the liquid cosmetic container shown in FIG. 1.
Figure 4:
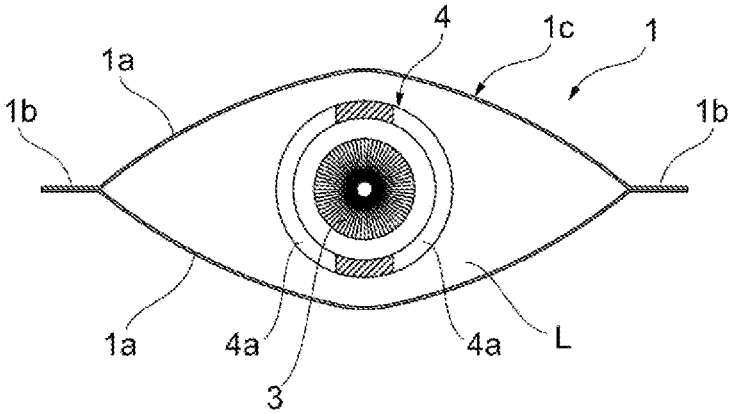
FIG. 4 is a cross sectional view in the IV-IV in FIG. 1.

First of all, a description will be given of the first embodiment shown in FIGS. 1 to 6. FIGS. 1 to 3 are respective perspective views showing the liquid cosmetic container in accordance with the first embodiment, FIG. 4 is a cross sectional view in the IV-IV in FIG. 1, FIG. 5 is a perspective view of a bag-like container, and FIG. 6 is a perspective view showing a lid portion with an application body. In this case, as a particularly preferable example, a description is given by setting a liquid cosmetic L to a mascara, and an application body 3 to a screw brush, however, the liquid cosmetic L may be set to a lip gloss and the application body 3 may be set to a flocky tip, or the application body 3 may be set to a comb, and it is of course possible to employ a liquid cosmetic container using the other liquid cosmetic and application body.

As shown in FIGS. 1 to 3, a liquid cosmetic container 100 is provided with a bag-like container 1 which accommodates the liquid cosmetic L, and a lid portion 2 with the application body 3 which is detachably installed to the bag-like container 1.

As shown in FIGS. 1 to 5, the bag-like container 1 has two films 1*a* and 1*a* which are formed as an approximately rectangular shape in a plan view, and a joint portion 1*b* which joins peripheral ends of the films 1*a* and 1*a* to each other, has a bag portion 1*c* in an inner side of the joint portion 1*b*, and further has an opening neck portion 1*d* which communicates an inner side and an outer side of the bag portion 1*c*.

The joint portion 1*b* is formed by aligning the films 1*a* and 1*a* with each other and bonding the ends of the films 1*a* and 1*a* to each other at a predetermined width, for example, in accordance with a thermal welding. Various materials can be used as the film 1*a*. As examples, it is possible to employ an olefin polyethylene, a polypropylene, a polyester PET and the like, and those materials obtained by depositing an aluminum, an alumina, a silica or the like thereto, and further, those materials obtained by laminating an aluminum film.

The bag portion 1*c* is formed in the inner side of the joint portion 1*b* by bonding the peripheral ends of the films 1*a* and 1*a* to each other, and accommodates the liquid cosmetic L in the inner portion thereof. The liquid cosmetic L is sealed by the lid portion 2 being installed to the bag-like container 1 as well as by the joint portion 1*b*. In this case, two films 1*a* and 1*a* are aligned and bonded, further, three or more films may be done so.

The opening neck portion 1*d* is provided with an attaching portion 1*e* which is attached to the joint portion 1*b*, and an installation portion 1*f* for detachably installing the lid portion 2 with the application body. The attaching portion 1*e* is provided in one end side of the joint portion in a longitudinal direction of the film 1*a* which is formed as the approximately rectangular shape in the plan view, among the joint portion 1*b*. This attaching portion 1*e* is structured such that both right and left side portions are firmly attached to the joint portion 1*b*, and a center portion is formed as a communication tube portion 1*g* (refer to FIG. 3) constructed as a cylindrical shape so as to communicate the inner side and the outer side of the bag portion 1*c*. The application body 3 can be inserted through the communication tube portion 1*g*.

The installation portion 1*f* is formed as a cylindrical shape coming next the communication tube portion 1*g* so as to be continuously provided in the communication tube portion 1*g* in such a manner as to protrude to an outer side. A male screw 1*h* which is screwed with the lid portion 2 with the application body and makes the lid portion 2 with the application body detachable is formed in an outer peripheral surface of the installation portion 1*f*.

Further, a cylindrical insertion portion 1*i* is provided in an inner peripheral surface of the installation portion 1*f*. The application body 3 can be inserted through the insertion portion 1*i* which has a scraping portion 1*j* (refer to FIG. 3) for scraping a surplus liquid cosmetic L attached to the application body 3 at a time when the application body 3 passes, in the inner peripheral surface of the insertion portion 1*i*.

In this case, particularly in the present embodiment, there is provided a cylindrical pipe portion 4 which is continuously provided in the communication tube portion 1*g* of the opening neck portion 1*d* and goes into the bag portion 1*c* coming next the communication tube portion 1*g*. The pipe portion 4 can accommodate the application body 3, and extends somewhat to the bottom portion side from the middle in the longitudinal direction of the bag-like container 1.

Further, the pipe portion 4 is provided with a slit 4*a* corresponding to an opening which can circulate the liquid cosmetic L by communicating an inner side and an outer side, in a peripheral surface thereof. The slit 4*a* extends in an axial direction of the pipe portion 4, and is open at a length of the application body from the vicinity of a leading end (a bottom portion) of the pipe portion 4 (refer to FIG. 3). Two slits 4*a* are provided here, and are open at a position which is opposed to the joint portion 1*b* (refer to FIG. 4). Further, the liquid cosmetic L goes into the pipe portion 4 through the slit 4*a* and the opening in the leading end (the bottom portion side), and the pipe portion 4 is filled with the liquid cosmetic L.

In this case, the pipe portion 4 is formed integrally with the attaching portion 1*e* constructing the opening neck portion 1*d* and the installation portion 1*f*, however, the pipe portion 4, the attaching portion 1*e* and the installation portion 1*f* may be formed integrally with the insertion portion 1*i* and the scraping portion 1*j*, and a combination of the integral formation can be optionally set. Further, all the pipe portion 4, the attaching portion 1*e*, the installation portion 1*f*, the insertion portion 1*i* and the scraping portion 1*j* may be set to independent parts and may be firmly attached.

As shown in FIGS. 1 to 3 and FIG. 6, the lid portion 2 with the application body is provided with the lid portion 2*a* which comes to the lid of the opening neck portion 1*d*, and the application body 3 which is provided in the lid portion 2*a*.

The lid portion 2*a* is constructed as a closed-end tubular shape, and has a female thread 2*h* which engages with the male screw 1*h* on the outer peripheral surface of the opening neck portion 1*d*, in an inner peripheral surface in an opening end side thereof. Further, the lid portion 2*a* is detachably installed to the bag-like container 1 by engaging the female thread 2*h* thereof with the male screw 1*h*.

Further, the lid portion 2*a* has a shaft portion 2*b* which protrudes out of the lid portion 2*a* to the bag-like container 1, inserts through the insertion portion 1*i* of the bag-like container 1 and goes into the pipe portion 4, and the application body 3 is attached to a leading end of the shaft portion 2*b*.

Further, as shown in FIGS. 2 and 3, if the lid portion 2*a* is installed to the opening neck portion 1*d* in accordance with an engagement of the threads 2*h* and 1*h* (if the lid portion 2*a* is fastened), the shaft portion 2*b* and the application body 3 go into the pipe portion 4 through the insertion portion 1*i* and the communication tube portion 1*g*, and the application body 3 reaches at the position at which the slit 4*a* of the pipe portion 4 is provided, whereby a whole length of the application body 3 is exposed out of the slit 4*a*.

In this case, in the liquid cosmetic container 100 mentioned above, a suspending hole 1*k* is provided in one side of an upper portion in the joint portion 1*b* of the bag-like container 1.

In accordance with the liquid cosmetic container 100 structured as mentioned above, the liquid cosmetic L is filled in the pipe portion 4 at a time of purchasing (at an initial time), and the application body 3 sufficiently dips in the liquid cosmetic L and the liquid cosmetic L is sufficiently attached to the application body.

At a time of using, the user releases the engagement of the female thread 2*h* of the lid portion 2*a* and the male screw 1*h* of the opening neck portion 1*d* so as to detach the lid portion 2*a* from the bag-like container 1, by turning the lid portion 2*a*. At this time, the application body 3 passes through the scraping portion 1*j* and the surplus liquid cosmetic L is scrapped off. The user sets before use in a state in which the liquid cosmetic L is appropriately attached to the application body 3, and installs to the bag-like container 1 while turning the lid portion 2*a* after the use.

Further, if the liquid cosmetic L within the pipe portion 4 goes down in accordance with the use, the user pushes (squeezes) the bag portion 1*c* in a state in which the lid portion 2*a* is installed to the bag-like container 1. Specifically, a portion having no pipe portion 4 (around the pipe portion 4) of the bag portion 1*c* is pushed.

Accordingly, the liquid cosmetic L goes into the pipe portion 4 through the slit 4*a*, and since the application body 3 reaches at the position at which the slit 4*a* of the pipe portion 4 is provided, at this time, the application body 3 reaching the slit 4*a* sufficiently dips into the liquid cosmetic L. Therefore, the user may detach the lid portion 2*a* from the bag-like container 1 thereafter in the same manner as mentioned above, and may apply the liquid cosmetic L which is sufficiently attached to the application body 3 to the portion to be applied.

Further, it is possible to sufficiently run short of the cosmetic L so as to sufficiently reduce the remaining amount, by repeating such a motion that the user pushes the bag portion 1*c*, each time when the liquid cosmetic L within the pipe portion 4 goes down.

Further, in accordance with the liquid cosmetic container 100 of the present embodiment, since the application body 3 is accommodated within the pipe portion 4 as mentioned above, it is possible to sufficiently protect the application body 3 by the pipe portion 4 even in the case that such a pressing force as to crush the bag portion 1*c* is erroneously applied.

Further, in accordance with the liquid cosmetic container 100 of the present embodiment, the following effects can be obtained. In other words, since the opening of the pipe portion 4 is formed as the slit 4*a* which extends in the axial direction of the pipe portion 4, it is possible to easily introduce the liquid cosmetic L into the pipe portion 4 through this slit 4*a*, and it is possible to further run short of the liquid cosmetic L so as to further reduce the remaining amount.

Further, since the slit 4*a* makes the whole length of the application body 3 expose, the application body 3 further sufficiently dips into the liquid cosmetic L from the slit 4*a*, and it is possible to further run short of the liquid cosmetic L so as to further reduce the remaining amount.

Further, since the slit 4*a* of the pipe portion 4 is open to the position which is opposed to the joint portion 1*b* which bonds the ends of the films 1*a* and 1*a* to each other, no opening is provided in the direction in which the pressing force crushing the bag portion 1*c* is applied (the front and back direction of the bag-like container 1; the vertical direction in FIG. 4). Therefore, it is possible to further protect the application body 3 by the peripheral wall of the pipe portion 4.

In this connection, in accordance with an experiment of the inventor of the present invention, the remaining amount of the liquid cosmetic L comes to 5% from 15%.

FIG. 7 is a view showing a liquid cosmetic container in accordance with a second embodiment of the present invention, and is a schematic plan view for explaining a shape of a joint portion.

A point at which the liquid cosmetic container 200 in accordance with the second embodiment is different from the liquid cosmetic container 100 in accordance with the first embodiment exist in a point that the joint portion opposed to the slit 4*a* of the pipe portion 4 in the joint portion 1*b* bonding the ends of the films 1*a* and 1*a* (refer to the first embodiment with regard to the pipe portion 4 and the slit 4*a*) is formed as a protruding portion 1*n* in which an inner edge 1*m* thereof protrudes toward the slit 4*a*. The inner edge 1*m* of the protruding portion 1*n* is formed such a shape as to gently curve toward an inner side in a plan view.

In accordance with the liquid cosmetic container 200 mentioned above, since there is formed such a flow path that the portion between the protruding portion 1*n* and the slit 4*a* is narrowed in comparison with the other portions (between the joint portion 1*b* and the pipe portion 4 in which the slit 4*a* is not opened), by the protruding portion 1*n* protruding toward the slit 4*a*, the liquid cosmetic L within the bag portion 1*c* circulates the vicinity of the slit 4*a* so as to easily go into the pipe portion 4 by the pressing operation of the bag portion 1*c* by the user. Therefore, it is possible to further run short of the liquid cosmetic L so as to further reduce the remaining amount.

FIG. 8 is a view showing a liquid cosmetic container in accordance with a third embodiment of the present invention, and is a schematic plan view for explaining a shape of a bag-like container and a joint portion.

A point at which the liquid cosmetic container 300 in accordance with the third embodiment is different from the liquid cosmetic container 200 in accordance with the second embodiment exist in a point that the protruding portion is formed as a protruding portion 1*q* in which an outer edge 1*p* is also formed as a curved shape extending along the inner edge 1*m*.

In accordance with the liquid cosmetic container 300 of the third embodiment mentioned above, it goes without saying that the same effect as the second embodiment can be obtained, since both side portions (the outer edge 1*p*) of the bag-like container are formed as the inward curved shape, a design characteristic is enhanced.

The present invention is specifically described above on the basis of the embodiments, however, the present invention is not limited to the embodiments mentioned above. For example, in the embodiments mentioned above, the opening of the pipe portion 4 is set to the slit 4*a* as a particularly preferable example, however, it may be constructed by a mere hole.

Further, for example, it can be applied to the liquid cosmetic container which is sealed by a gusset provided in a bottom portion.

The entire disclosure of Japanese Patent Application No. 2010-202135 filed Sep. 9, 2010, is expressly incorporated by reference herein.

What is claimed is:

1. A liquid cosmetic container comprising:

a bag-like container being provided with a bag portion formed by aligning at least two films to join ends of the films to each other to form a joint portion, and having an opening neck portion communicating an inner side and an outer side of said bag portion as well as accommodating a liquid cosmetic within the bag portion;

a lid portion being detachably installed to said opening neck portion to form a lid of said opening neck portion, the opening neck portion being provided with an attaching portion which is attached to the joint portion, and an installation portion for detachably connecting with the lid portion; and an application body being provided in said lid portion and goes into said bag portion through said opening neck portion at a time when said lid portion is installed to said opening neck portion, a pipe portion being continuously provided in said opening neck portion so as to extend in such a manner as to head for a bottom portion side within said bag portion, being formed as a tubular shape capable of accommodating said application body and protecting said application body from being deformed, and being provided in its peripheral surface with at least one opening enabling said liquid cosmetic to go into an internal portion, and wherein said application body goes into said pipe portion so as to reach a position at which said opening of said pipe portion is provided, at a time when said lid portion is installed to said opening neck portion; and wherein a gap or clearance is provided along the entire length of such a part of the pipe portion as is located within the bag portion at the time when the lid s portion is installed to the opening neck portion between an inner peripheral surface of the pipe portion and an outer surface of the application body.

2. The liquid cosmetic container as claimed in claim 1, wherein said opening of said pipe portion is at least one slit extending in an axial direction of said pipe portion.

3. The liquid cosmetic container as claimed in claim 2, wherein said slit is exposed at a whole length of said application body.

4. The liquid cosmetic container as claimed in claim 1, wherein said opening of said pipe portion is open to a position which is opposed to the joint portion joining said film ends to each other.

5. The liquid cosmetic container as claimed in claim 2, wherein said opening of said pipe portion is open to a position which is opposed to the joint portion joining said film ends to each other.

6. The liquid cosmetic container as claimed in claim 3, wherein said opening of said pipe portion is open to a position which is opposed to the joint portion joining said film ends to each other.

7. The liquid cosmetic container as claimed in claim 4, wherein the joint portion joining said film ends to each other protrudes toward said opening in a portion which is opposed to said opening of said pipe portion.

8. The liquid cosmetic container as claimed in claim 5, wherein the joint portion joining said film ends to each other protrudes toward said opening in a portion which is opposed to said opening of said pipe portion.

9. The liquid cosmetic container as claimed in claim 6, wherein the joint portion joining said film ends to each other protrudes toward said opening in a portion which is opposed to said opening of said pipe portion.

10. The liquid cosmetic container as claimed in claim 1, wherein the pipe portion is formed integrally with the attaching portion and the installation portion.

11. The liquid cosmetic container as claimed in claim 1, wherein the pipe portion has an opening at a leading end thereof enabling said liquid cosmetic to go into the internal portion.

12. The liquid cosmetic container as claimed in claim 1, wherein a suspending hole is provided in one side of an upper portion in the joint portion of the bag-like container.

13. A liquid cosmetic container comprising:

a bag-like container being provided with a bag portion formed by aligning at least two films to join ends of the films to each other to form a joint portion, and having an opening neck portion communicating an inner side and an outer side of said bag portion as well as accommodating a liquid cosmetic within the bag portion;

a lid portion being detachably installed to said opening neck portion to form a lid of said opening neck portion;

the opening neck portion being provided with an attaching portion which is attached to the joint portion, and an installation portion for detachably connecting with the lid portion;

an application body being provided in said lid portion and goes into said bag portion through said opening neck portion at a time when said lid portion is installed to said opening neck portion; and a pipe portion being continuously provided in said opening neck portion so as to extend in such a manner as to head for a bottom portion side within said bag portion, being formed as a tubular shape capable of accommodating said application body, and being provided in its peripheral surface with at least one opening enabling said liquid cosmetic to go into an internal portion;

wherein said application body goes into said pipe portion so as to reach a position at which said opening of said pipe portion is provided, at a time when said lid portion is installed to said opening neck portion, wherein said opening of said pipe portion is open to a position which is opposed to the joint portion joining said film ends to each other, and wherein the joint portion joining said film ends to each other protrudes toward said opening in a portion which is opposed to said opening of said pipe portion.

14. A liquid cosmetic container comprising:

a bag-like container being provided with a bag portion formed by aligning at least two films to join ends of the films to each other to form a joint portion, and having an opening neck portion communicating an inner side and an outer side of said bag portion as well as accommodating a liquid cosmetic within the bag portion;

a lid portion being detachably installed to said opening neck portion to form a lid of said opening neck portion;

the opening neck portion being provided with an attaching portion which is attached to the joint portion, and an installation portion for detachably connecting with the lid portion;

an application body being provided in said lid portion and goes into said bag portion through said opening neck portion at a time when said lid portion is installed to said opening neck portion; and a pipe portion being continuously provided in said opening neck portion so as to extend in such a manner as to head for a bottom portion side within said bag portion, being formed as a tubular shape capable of accommodating said application body, and being provided in its peripheral surface with at least one opening enabling said liquid cosmetic to go into an internal portion;

wherein said application body goes into said pipe portion so as to reach a position at which said opening of said pipe portion is provided, at a time when said lid portion is installed to said opening neck portion, wherein said opening of said pipe portion is at least one slit extending in an axial direction of said pipe portion, wherein said opening of said pipe portion is open to a position which is opposed to the joint portion joining said film ends to each other, and wherein the joint portion joining said film ends to each other protrudes toward said opening in a portion which is opposed to said opening of said pipe portion.

* * * * *